US008647815B1

(12) United States Patent
Kuroki et al.

(10) Patent No.: US 8,647,815 B1
(45) Date of Patent: Feb. 11, 2014

(54) METHOD OF MANUFACTURING COPPER ELECTRODE

(75) Inventors: Masakatsu Kuroki, Kanagawa (JP); Takeshi Kono, Kanagawa (JP)

(73) Assignee: E I du Pont de Nemours and Company, Wilmington, DE (US)

( * ) Notice: Subject to any disclaimer, the term of this patent is extended or adjusted under 35 U.S.C. 154(b) by 0 days.

(21) Appl. No.: 13/558,912

(22) Filed: Jul. 26, 2012

(51) Int. Cl.
*G03F 7/26* (2006.01)

(52) U.S. Cl.
USPC ..... 430/311; 252/512; 427/126.1

(58) Field of Classification Search
USPC ..... 430/311, 319; 252/512; 427/126.1
See application file for complete search history.

(56) References Cited

U.S. PATENT DOCUMENTS 8,129,088 B2 3/2012 Kuroki

*Primary Examiner* — Brittany Raymond

(57) ABSTRACT

A method for manufacturing an electrode comprising the steps of: applying onto a substrate a conductive paste to form a conductive paste layer comprising; (i) 100 parts by weight of a copper powder coated with a metal oxide selected from the group consisting of silicon oxide ($SiO_2$), zinc oxide (ZnO), aluminum oxide ($Al_2O_3$), titanium oxide ($TiO_2$), magnesium oxide (MgO) and a mixture thereof; (ii) 5 to 30 parts by weight of a boron powder; and (iii) 0.1 to 10 parts by weight of a glass frit; dispersed in (iv) an organic vehicle; and firing the conductive paste in air.

10 Claims, 1 Drawing Sheet

METHOD OF MANUFACTURING COPPER ELECTRODE

FIELD OF THE INVENTION

The invention relates to a method of manufacturing a copper electrode and a conductive paste used in the method.

TECHNICAL BACKGROUND OF THE INVENTION

A boron powder is used in a combination with copper (Cu) powder in a conductive paste to form a copper electrode in order to reduce the Cu powder oxidation during firing in air. However the boron powder can be oxidized to flow out to cause glassy elution during firing as seen in FIG. 2. The elution could cause a defect such as breaking and open line in the copper electrode.

U.S. Pat. No. 8,129,088 discloses an air firing type of electrode that is formed with a photosensitive paste containing a copper powder, a boron powder, a glass frit, a photopolymerization initiator, photopolymerizable monomer, and organic medium.

BRIEF SUMMARY OF THE INVENTION

An object is to provide a method of forming an electrode containing mainly copper by firing in air.

An aspect of the invention relates to a method for manufacturing an electrode comprising the steps of: applying onto a substrate a conductive paste to form a conductive paste layer comprising; (i) 100 parts by weight of a copper powder coated with a metal oxide selected from the group consisting of silicon oxide ($SiO_2$), zinc oxide (ZnO), aluminum oxide ($Al_2O_3$), titanium oxide ($TiO_2$), magnesium oxide (MgO) and a mixture thereof; (ii) 5 to 30 parts by weight of a boron powder; and (iii) 0.1 to 10 parts by weight of a glass frit; dispersed in (iv) an organic vehicle; and firing the conductive paste in air.

Another aspect of the invention relates to a conductive paste comprising; (i) 100 parts by weight of a copper powder coated with a metal oxide selected from the group consisting of silicon oxide ($SiO_2$), zinc oxide (ZnO), aluminum oxide ($Al_2O_3$), titanium oxide ($TiO_2$), magnesium oxide (MgO) and a mixture thereof; (ii) 5 to 30 parts by weight of a boron powder; and (iii) 0.1 to 10 parts by weight of a glass frit; dispersed in (iv) an organic vehicle.

A copper electrode having less elution can be formed by the present invention.

DETAILED DESCRIPTION OF THE INVENTION

Figure 1:
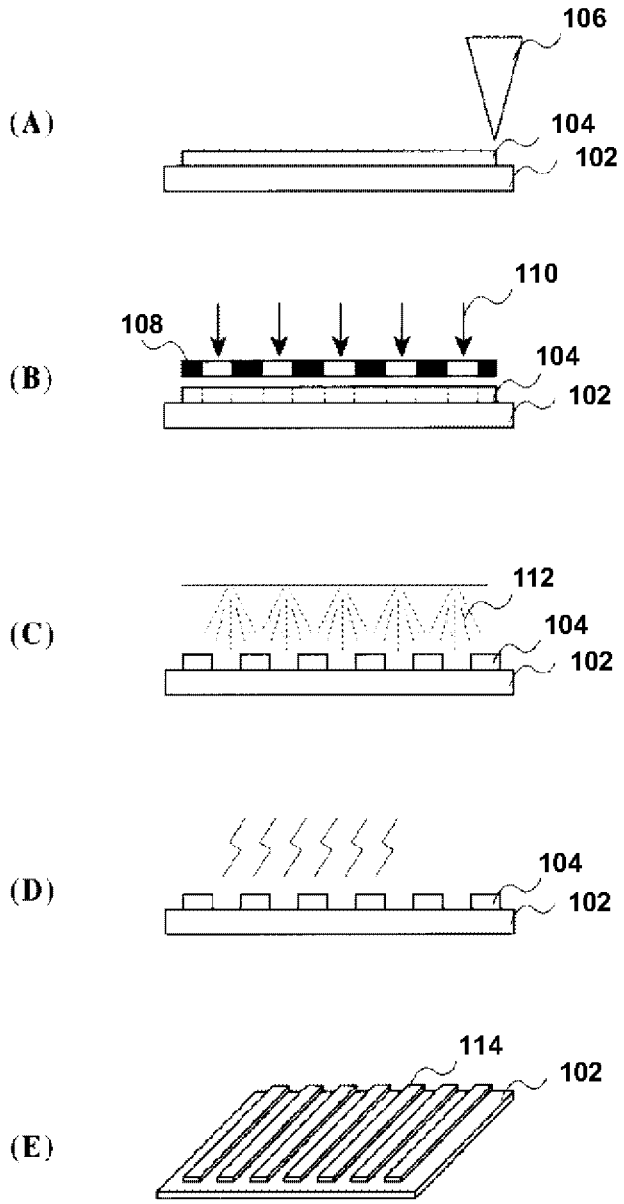
FIG. 1, (A) to (E) explains a photolithography method of manufacturing an electrode.

The Cu electrode is formed by firing a conductive paste in air. The conductive paste contains inorganic powder such as Cu powder dispersed into an organic vehicle to form a "paste", having suitable viscosity for applying on a substrate. The method of manufacturing the Cu electrode and the conductive paste is explained respectively below.

Method of Manufacturing an Electrode

The Cu electrode is formed by applying a conductive paste onto a substrate to form a conductive paste layer and firing the conductive paste layer in air.

There is no restriction on the substrate. The substrate can be selected depending on electrical devices; for example, a glass substrate for plasma display panel (PDP), a semiconductor substrate for solar cell, and a ceramic substrate for capacitor electrode. In an embodiment, the substrate can be selected from the group consisting of a glass substrate, a semiconductor substrate, a ceramic substrate and a metal substrate. When the substrate is a metal substrate or a semiconductor substrate, an insulating layer can be formed on the side on which the electrode is formed.

The way of applying the conductive paste on the substrate can be screen printing, nozzle dispensing, or offset printing. The screen printing that can apply the conductive paste on the substrate in a short time is often used. The pattern of the conductive paste layer can be any desired electrode pattern such as line(s) and square.

The conductive paste layer on the substrate can be optionally dried for, for example 10 to 20 minutes at 70 to 100° C. in an oven.

The conductive paste layer on the substrate is fired in air. A furnace set with a predetermined temperature and time profile can be available. The Cu powder sinters during firing to become the electrode having a sufficient conductivity. The organic vehicle could be removed by being burned off or carbonized during firing.

The term, "firing in air" or "air firing", essentially refers to firing without replacing the atmosphere in the firing space with a gas containing no oxygen or less oxygen than the surrounding atmosphere around the firing space. In an embodiment, the air surrounding the firing equipment is used as the firing atmosphere without replacing the firing atmosphere with other gas(es).

The firing condition can vary depends on substrate type, conductive paste layer pattern or properties of the conductive paste. However, the electrode can be generally obtained by firing the conductive paste at a setting peak temperature of 400 to 1000° C. and the firing time of 10 seconds to 3 hours in an embodiment. The setting peak temperature can be 700 to 1000° C. in another embodiment, and 400 to 800° C. in another embodiment. The firing time can be 10 seconds to 10 minutes in another embodiment, 0.5 to 3 hours in an embodiment. The firing condition can be adjusted by take into consideration the firing temperature and the firing time. For example, the conductive paste can be fired at a high temperature for a short time or low temperature for a long time when the substrate is easily damaged by the high temperature.

The firing time here is the time from starting and ending of firing, for example, from the entrance to the exit of the furnace.

The average width of the electrode can be 10 to 500 μm in an embodiment, 30 to 150 μm in another embodiment, 50 to 110 μm in another embodiment, and the average thickness can be 1 to 200 μm in an embodiment, 1 to 100 μm in another embodiment, 1 to 50 μm in another embodiment.

The method of manufacturing the Cu electrode can employ photolithography in another embodiment. The method can further contain a step of exposing the conductive paste layer on the substrate to light between the step of applying and the step of firing described above. In more detail, the conductive paste can be applied onto the substrate with a desired pattern, cured by exposure to light and then fired. When the conductive paste layer or the substrate is unfavorable to be wet, the conductive paste layer can be cured by photo-energy and fired without an aqueous development.

In another embodiment, the photolithographic method can contain the step of exposing the conductive paste layer on the substrate to light and a step of developing the exposed conductive paste layer with an aqueous solution between the step of applying and the step of firing described above. The photolithographic method using the development step is advantageous especially when forming a fine pattern.

The conductive paste for the photolithographic method contains a photopolymerizable compound and a photopolymerization initiator to be photosensitive.

The photolithographic method of manufacturing the electrode containing both steps of exposing and developing is explained with reference to the drawings FIG. 1.

The conductive paste can be applied onto the substrate 102 by an applying tool 106, for example a screen printing machine, to form a conductive paste layer 104 as illustrated in FIG. 1(A). The conductive paste can be applied onto entire surface of the substrate in an embodiment. The conductive paste layer 104 can be multiple layers by applying the conductive paste twice or more. The conductive paste composition of the each layer can be different in another embodiment. At least one layer out of the multiple layers contains the Cu powder.

The conductive paste layer 104 can be optionally dried. When the drying step is carried out, the drying condition can be at 70 to 250° C. for 1 to 30 minutes in an oven or drier.

The conductive paste layer 104 is then patterned by being exposed to light and developed with an aqueous solution. The conductive paste layer 104 can be exposed to light 110 such as ultraviolet ray through a photo mask 108 having a desired pattern so that the exposed area is cured as illustrated in FIG. 1(B). The gap between the photo mask 108 and the conductive paste layer can be 50 to 400 μm.

The exposing condition differs depending on the type of the photosensitivity of the conductive paste or thickness of the conductive paste layer 104. The conductive paste layer can be generally cured by photo energy in the range of 100 to 8000 $mJ/cm^2$ of light intensity and 5 to 200 seconds of light exposure time in an embodiment. The light intensity can be 10 to 50 $mW/cm^2$ in an embodiment.

The conductive paste layer 104 is then developed. To develop, an alkaline solution 112 such as a 0.4% sodium carbonate solution can be sprayed to the conductive paste layer 104 to remove the unexposed area of the conductive paste layer so that the cured pattern shows up as illustrated in FIG. 1(C). The developing time can be decided to be 1.1 to 4 times longer than the time that an unexposed conductive paste layer on the substrate is completely washed off with the alkaline solution.

The patterned conductive paste layer 104 after development is fired in air as illustrated in FIG. 1(D). The firing setting peak temperature can be 450 to 700° C. and firing time can be 0.5 to 3 hours in an embodiment.

The electrode 114 is formed after firing as illustrated in FIG. 1(E). The electrode formed by photolithographic method can be a fine pattern with, for example, width of 10 to 150 μm and thickness of 1 to 50 μm.

The method of manufacturing the electrode can be applicable to any electrode formed in electrical devices such as solar cell, plasma display panel (PDP), resistor, capacitor, heater, touch panel, and defogger on an automotive window. The photolithographic method can be applicable to manufacturing a PDP that has fine line electrodes.

Next, the conductive paste composition is explained in detail below. The conductive paste comprises at least (i) a copper powder, ii) a boron powder; and iii) a glass frit; dispersed in (iv) an organic vehicle.

(i) Copper Powder

The conductive paste contains a copper (Cu) powder to impart conductivity to electrodes. The Cu powder contains core Cu and coating of a metal oxide, unless especially otherwise specified. The core Cu can be pure Cu, or a Cu alloy with nickel, silver, aluminum, zinc, tin, or mixture thereof in an embodiment. The pure Cu can have purity at least 80% in an embodiment, at least 90% in another embodiment, at least 95% in another embodiment. The Cu powder is coated with a metal oxide selected from the group consisting of silicon oxide ($SiO_2$), zinc oxide (ZnO), aluminum oxide ($Al_2O_3$), titanium oxide ($TiO_2$), magnesium oxide (MgO) and a mixture thereof. The Cu powder can be coated with ZnO in another embodiment. The Cu powder can be coated with the metal oxide powder or with the metal oxide layer.

The metal oxide coating the Cu powder can be 0.1 to 8 weight percent (wt %) in an embodiment, 0.3 to 6.2 wt % in another embodiment, 0.5 to 5.2 wt % in another embodiment, and 0.8 to 3.5 wt % in still another embodiment, based on the weight of the Cu powder. The Cu powder coated with the metal oxide in that range can improve elusion while maintaining the sufficient conductivity as shown in Example below.

Particle diameter (D50) of the Cu powder can be 0.08 to 10 μm in an embodiment, 0.2 to 6.0 μm in another embodiment, 0.3 to 2.5 μm in another embodiment. The conductive paste can be dispersed well in the organic vehicle when the particle diameter of the Cu powder is in the range. In photolithography, the conductive paste can be cured well at the exposure when the particle diameter of the Cu powder is in the range. The particle diameter is obtained by measuring the distribution of the particle diameters by using a laser diffraction scattering method and can be defined as D50. Microtrac model X-100 is an example of the commercially-available devices.

The Cu powder can be spherical, flaky or irregular in shape in an embodiment. When employing the photolithographic method, the conductive paste comprising the spherical Cu powder can be advantageous on photosensitivity.

The copper powder can be at least 30 to 95 wt % in an embodiment, 35 to 92 wt % in another embodiment, 40 to 90 wt % in another embodiment, based on the weight of the conductive paste. Especially when the conductive paste is photosensitive, the Cu powder can be 30 to 70 wt % in an embodiment, 35 to 62 wt % in another embodiment based on the weight of the conductive paste. When the conductive paste is non-photosensitive, the Cu powder can be 60 to 95 wt % in another embodiment, 67 to 92 wt % in another embodiment based on the weight of the conductive paste. The Cu powder in that range could give the electrode sufficient conductivity.

Besides the Cu powder, any other additional metal powder can be added to the conductive paste to adjust the conductivity of the electrode. A powder of silver (Ag), gold (Au), palladium (Pd), aluminum (Al), platinum (Pt) powder, and alloy powder of these metals can be examples. The amount of the additional metal powder can be 5 wt % at the maximum based on the weight of the conductive paste in another embodiment.

The Cu powder coated with the metal oxide can be manufactured as follows in an embodiment. A metal oxide powder can be fix on the surface of the bare Cu powder by mechanochemical treatment, and then the Cu powder with the metal oxide powder can be heated at 500 to 1000° C. in reductive atmosphere or under an inert gas atmosphere. To fix the metal oxide powder on the bare Cu powder, the metal oxide powder and the bare Cu powder are mixed or agitated well. An equipment that can get these powders collide each other can be available. Surface area of the metal oxide powder to coat the Cu powder is 50 $m^2/g$ or larger in an embodiment.

A gas phase method such as Sputtering and Chemical Vapor Deposition (CVD) or liquid phase method such as sol-gel process can be available to make the Cu powder coated with the metal oxide.

(ii) Boron Powder

Boron powder is used to reduce oxidation of the Cu powder during firing in air. The increase in electrode resistivity resulting from copper oxidation can be inhibited by adding boron powder to the conductive paste.

The boron powder is 5 to 30 parts by weight based on 100 parts by weight of the Cu powder. The boron powder can be 10 to 28 parts by weight in another embodiment, 12 to 26 parts by weight in another embodiment based on 100 parts by weight of the Cu powder. The conductive paste containing the boron powder in the range could obtain sufficiently low resistivity as shown in Example below.

Particle diameter (D50) of the boron powder can be 0.1 to 5 μm in an embodiment, 0.3 to 3 μm in another embodiment, 0.6 to 2.3 μm in another embodiment in a viewpoint of uniform dispersion of the boron powder in the conductive paste. The conductive paste can be cured well when the particle diameter of the boron powder is in the range. The particle diameter can be measured in the same way for the Cu powder described above.

Surface area (SA) of the boron powder can be 3 to 20 $m^2/g$ in an embodiment, 5 to 16 $m^2/g$ in another embodiment, 7 to 14 $m^2/g$ in another embodiment. When the boron powder surface area is in the range, the oxidation of the copper powder could reduce. The SA can be measured by a BET-point method (JIS-Z-8830). Quantachrome Nova 3000 BET Specific Surface Area Analyzer can be available to measure the SA.

The Cu powder can be spherical, flaky or irregular in shape in an embodiment.

The boron powder can comprise boron at least 80 wt % of the boron powder in an embodiment, at least 89 wt % of the boron powder in another embodiment, at least 93 wt % of the boron powder in an embodiment.

(iii) Glass Frit

Glass frit functions to help sintering the conductive powder or to increase the adhesion of the electrode to the substrate. Complex oxides that could behave just like the glass frit in the firing temperature can be also considered as the glass frit.

The glass frit can be 0.1 to 10 parts by weight in an embodiment, 0.2 to 8 parts by weight in another embodiment, 0.3 to 4 parts by weight in another embodiment, based on 100 parts by weight of the Cu powder. With such amount, the glass frit can serve the function above.

Particle diameter (D50) of the glass frit can be 0.1 to 5 μm in an embodiment, 0.3 to 3 μm in another embodiment, 0.6 to 2.3 μm in another embodiment, from a viewpoint of uniform dispersion in the conductive paste. The particle diameter can be measured in the same way for the Cu powder described above.

The chemical composition of the glass frit here is not limited. Any glass frits can be suitable for use in the conductive paste. For example, a lead-boron-silicon glass frit, a lead-free bismuth glass frit can be available.

Softening point of the glass frit can be 390 to 700° C. in an embodiment. When the softening point is in the range, the glass frit could melt properly to obtain the effects mentioned above. The softening point can be determined by differential thermal analysis (DTA).

(iv) Organic Vehicle

The inorganic powders such as the Cu powder is dispersed into the organic vehicle to form a viscous composition called "paste", having suitable viscosity for applying on a substrate with a desired pattern.

There is no restriction on the composition of the organic vehicle. The organic vehicle can contain at least an organic polymer and optionally a solvent in an embodiment.

A wide variety of inert viscous materials can be used as the organic polymer, for example ethyl cellulose, ethylhydroxyethyl cellulose, wood rosin, epoxy resin, phenolic resin, acrylic resin or a mixture thereof.

When the conductive paste is developed in the photolithographic method, the developability in an aqueous solution can be achieved by using the organic polymer containing acrylic polymer having a side chain of a hydroxyl group or a carboxyl group which can be soluble in the alkaline solution such as 0.4% sodium carbonate solution. The acrylic polymer can be copolymer of methyl methacrylate and methacrylic acid (MMA-MAA). A cellulose polymer such as hydroxyethyl cellulose, hydroxypropyl cellulose and hydroxyethyl hydroxypropyl cellulose that is water-soluble can be also available. The organic polymer can be a mixture of the acrylic polymer and the cellulose polymer.

The solvent such as Texanol or terpineol can be used to adjust the viscosity of the conductive paste to be preferable for applying onto the substrate. The viscosity of the conductive paste can be 5 to 300 Pascal second measured on a viscometer Brookfield HBT using a spindle #14 at 10 rpm at room temperature in an embodiment.

The organic vehicle can further comprise a photopolymerization initiator and a photopolymerizable compound in the photolithographic method. The photopolymerization initiator is thermally inactive at 185° C. or lower, but it generates free radicals when it is exposed to an actinic ray. A compound that has two intra-molecular rings in the conjugated carboxylic ring system can be used as the photo-polymerization initiator, for example ethyl 4-dimethyl aminobenzoate (EDAB), diethylthioxanthone (DETX), and 2-Methyl-1[4-(methylthio)phenyl]-2-morpholinopropan-1-one. The photopolymerization initiator can be 2 to 9 wt % based on the weight of the organic vehicle in an embodiment.

The photopolymerization compound can comprise an organic monomer or an oligomer that includes ethylenic unsaturated compounds having at least one polymerizable ethylene group. Examples of the photo-polymerization compound are ethocylated (6) trimethylolpropane triacrylate, and dipentaerythritol pentaacrylate. The photo-polymerization compound can be 20 to 45 wt % based on the weight of the organic vehicle in an embodiment.

The organic vehicle can be 10 to 120 parts by weight in an embodiment, 20 to 117 parts by weight in another embodiment, 40 to 110 parts by weight in another embodiment based on 100 parts by weight of the Cu powder. In addition, an organic additive such as a dispersing agent, a stabilizer and a plasticizer can be added to the organic vehicle.

For the organic vehicle to be used in photolithographic method, U.S. Pat. No. 5,143,819, U.S. Pat. No. 5,075,192, U.S. Pat. No. 5,032,490, U.S. Pat. No. 7,655,864 can be herein incorporated by reference.

(v) Additional Inorganic Powder

Additional inorganic powder can be optionally added to the conductive paste. The additional inorganic powder is not essential. However the additional inorganic powder can improve various properties of the electrode, such as adhesion and conductivity.

The additional inorganic powder can be selected from the group consisting of silica ($SiO_2$) powder, indium tin oxide (ITO) powder, zinc oxide (ZnO) powder, alumina ($Al_2O_3$) powder and mixture thereof in an embodiment. The additional inorganic powder can be $SiO_2$ powder in another embodiment, a fumed silica powder in another embodiment. The additional inorganic powder can comprise at least 80 wt % of one or more of these oxides in an embodiment, at least 89 wt % in another embodiment, and at least 93 wt % in an embodiment based on the weight of the additional inorganic powder.

The additional inorganic powder can be 0.5 to 10 parts by weight in an embodiment, 1.5 to 7 parts by weight in another embodiment, 2.9 to 5.6 parts by weight in another embodiment based on 100 parts by weight of the Cu powder. Particle diameter (D50) of the additional inorganic powder can be 5 nm to 1 μm in an embodiment, 7 nm to 200 nm in another embodiment, and 9 nm to 100 nm in still another embodiment. The particle diameter (D50) can be measured in the same way for the Cu powder described above.

Surface area (SA) of the additional inorganic powder can be 50 to 325 $m^2/g$ in an embodiment, 120 to 310 $m^2/g$ in another embodiment, and 180 to 260 $m^2/g$ in another embodiment. The SA can be measured in the same way for the boron powder described above.

EXAMPLE

The invention is illustrated below by examples. The examples were the electrodes formed by photolithographic method. However, the examples are for illustrative purposes only, and are not intended to limit the invention.

1. Preparation of Conductive Paste

To obtain an organic vehicle, a mixing tank was charged with Texanol, MMA-MAA copolymer, a photo-polymerization initiator, a photo-polymerization monomer and an organic additive and the mixture in the tank was stirred well. To this organic vehicle, the inorganic materials below were added to form a conductive paste. The conductive paste was mixed until the inorganic powders were wet with the organic vehicle and further dispersed using a 3-roll mill. The viscosity was between 20 to 60 Pascal second.

Copper powder: Spherical Cu powder coated with $SiO_2$. The amount of $SiO_2$ was 3 wt % or 5 wt % based on the weight of Cu powder as shown in Table 1. For comparison, Spherical bare Cu powder without the $SiO_2$ coating was used in Comparative (Com.) Example 1.

Boron powder: Irregular shape of boron powder with particle diameter of 1.0 μm and surface area of 10.0 $m^2/g$ (Boron Amorphous-I, H.C. Starck Company).

Additional inorganic powder: Fumed silica powder with surface area of 200 $m^2/g$ and particle diameter of 12 nm (Aerosil 200 from Evonik Industries).

Glass frit: Bi—B—Al glass frit with particle diameter of 0.9 μm and Ts of 590° C.

2. Forming Electrode

Precautions were taken to avoid dirt contamination, as contamination of dirt during the preparation of the paste and the manufacture of the parts can cause defects.

2-1: Applying

The conductive paste was screen printed onto a glass substrate through a #300 mesh screen mask to form a conductive paste layer of 2×2 inch block pattern. The conductive paste layer was dried IR furnace for 10 minutes at 100° C. The dried conductive paste layer was typically 6 to 8 μm thickness.

2-2: Exposure

The dried paste was exposed to light for 100 seconds through a photo mask using a collimated UV radiation source (light intensity: 17-20 $mW/cm^2$; exposure: 2000 $mJ/cm^2$, exposure time: 100-120 seconds). The mask pattern was one line with 1000 mm long and 100 μm wide which was folded into S-shaped.

2-3: Development

The exposed sample was placed on a conveyor to go in a developing device filled with 0.4 wt % sodium carbonate aqueous solution as the developer. The developing time in the each example was between 7 to 17 seconds which were 1.5 times longer than the previously measured time in which the unexposed area of the conductive paste layer on the substrate was completely washed off with the alkaline solution. The one line of S-shaped bend appeared.

2-4: Firing

The developed conductive paste layer was fired in air using a furnace (Roller Hearth Continuous Furnaces from KOYO THERMO SYSTEMS KOREA CO., LTD.). The firing condition was the setting peak temperature of 600° C. for 10 minutes. The total firing time, from the entrance to the exit of the furnace, was 1.5 hours. The fired electrode had thickness of 4.5 μm in average.

3: Measurement

Figure 2:
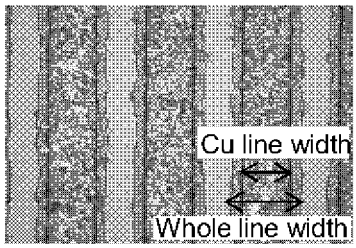
FIG. 2 shows copper lines having the elution.

Elution width of the electrode was observed and measured by a microscope having a measurement system CP30. The elution width was a value of the whole line width including glassy elution from which the copper line width was subtracted (refer to FIG. 2), that was expressed by the equation: the elution width (μm)=Whole line width (μm)−copper line width (μm). The elution was expressed as a relative value when the elution width of Comparative Example 1 was set to zero. The larger negative value means less elution width based on the elution width of Comparative Example 1.

The volume resistivity was calculated by the following equation (1). The resistance (Ω) was measured with a multimeter (34401A from Hewlett-Packard Company). The width, the thickness, and the length of the electrode were measured by the microscope having the measurement system.

$$\text{Volume resistivity } (\Omega\cdot\text{cm}) = \text{Resistance } (\Omega) \times \text{width (cm) of the electrode} \times \text{thickness (cm) of the electrode/length (cm) of the electrode} \quad (1)$$

4: Result

The elution width and volume resistivity were dramatically improved by replacing the bare no-coat Cu powder (Com. Example 1) with $SiO_2$-coat Cu powder (Example 1 and 2) in the conductive paste as shown in Table 1. The volume resistivity of the electrode in Com. Example 1 was too high to measure because the elution possibly caused Cu outflow.

TABLE 1

| Composition (parts by weight) | Example 1 | Example 2 | Com. Example 1 |
|---|---|---|---|
| Cu powder[1)] | 3 wt % SiO2[2)] | 5 wt % SiO2[3)] | No-coat |
| | 100 | 100 | 100 |
| B powder | 21.2 | 21.2 | 21.2 |
| $SiO_2$ powder | 4.1 | 4.1 | 4.1 |
| Glass frit | 0.6 | 0.6 | 0.6 |
| Organic vehicle | 101.5 | 101.5 | 101.5 |
| Relative elution width | −61 | −75 | 0 |
| Volume resistivity (Ω · cm) | $5.2 \times 10^5$ | $8.6 \times 10^5$ | —[5)] |

[1)]Upper line: type of Cu powder, lower line: Cu powder content

[2)]3 wt % $SiO_2$ coat 1050Y from Mitsui Mining & Smelting CO. LTD., SA: 1.24 $m^2/g$, D50: 0.75 μm. $SiO_2$ was 3 wt % based on the weight of the Cu powder.

[3)]5 wt % $SiO_2$ coat 1050Y from Mitsui Mining & Smelting CO. LTD., SA: 1.24 $m^2/g$, D50: 0.75 μm. $SiO_2$ was 5 wt % based on the weight of the Cu powder.

[4)]Bare Cu powder 1100Y from Mitsui Mining & Smelting CO. LTD SA: 0.86 $m^2/g$, D50 ;1.18 μm

[5)]Unmeasurable level

The other oxides to coat the Cu powder were examined. The electrodes were made in the same manner in Example 1 except that the Cu powder coated with $Al_2O_3$, $TiO_2$ or ZnO of 1 wt % based on the weight of the Cu powder was used; and the firing setting peak temperature was 580° C.

As a result, the Cu powder coated with $Al_2O_3$, $TiO_2$ or ZnO decreased the elution width (Example 3, 4 and 5) compare to the bare Cu powder (Com. Example 2) as shown in Table 2. The volume resistivity increased by replacing bare Cu powder (Com. Example 2) with the Cu powder coated with oxides (Example 3, 4 and 5) but still kept acceptably low. The electrode in Com. Example 2 happened to obtain the relatively low resistivity, but the elution width was large enough to potentially cause a defect in the electrode.

TABLE 2

| Composition (parts by weight) | Example 3 | Example 4 | Example 5 | Com. Example 2 |
|---|---|---|---|---|
| Cu powder[1)] | 1 wt % $Al_2O_3$ coat[2)] | 1 wt % $TiO_2$ coat[3)] | 1 wt % ZnO coat[4)] | No-coat[5)] |
| | 100 | 100 | 100 | 100 |
| B powder | 21.2 | 21.2 | 21.2 | 21.2 |
| $SiO_2$ powder | 4.1 | 4.1 | 4.1 | 4.1 |
| Glass frit | 0.6 | 0.6 | 0.6 | 0.6 |
| Organic vehicle | 101.5 | 101.5 | 101.5 | 101.5 |
| Relative elution width | −20 | −40 | −81 | 0 |
| Volume resistivity (Ω · cm) | 3.7 × 105 | 5.4 × 105 | 3.9 × 105 | 2.8 × 105 |

[1)]Upper line: type of Cu powder, lower line: Cu powder content
[2)]1 wt % $Al_2O_3$ coat 1100Y from Mitsui Mining & Smelting CO. LTD., SA: 0.86 $m^2/g$, D50: 1.18 μm. $Al_2O_3$ was 1 wt % based on the weight of the Cu powder.
[3)]1 wt % $TiO_2$ coat 1100Y from Mitsui Mining & Smelting CO. LTD., SA: 0.86 $m^2/g$, D50: 1.18 μm. $TiO_2$ was 1 wt % based on the weight of the Cu powder.
[4)]1 wt % ZnO coat 1100Y from Mitsui Mining & Smelting CO. LTD., SA: 0.86 $m^2/g$, D50: 1.18 μm. ZnO was 1 wt % based on the weight of the Cu powder.
[5)]Bare Cu powder 1100Y from Mitsui Mining & Smelting CO. LTD SA: 0.86 $m^2/g$, D50: 1.18 μm From Examples above, the ZnO-coat Cu powder seemed to be more effective on decrease the elution, so the amount of ZnO to coat the Cu powder was examined. The electrodes were made in the same manner in Example 1 except that the composition was as shown in Table 3; and the firing setting peak temperature of firing was 580° C. The line with 50 μm was also separately formed. For a comparison, the ZnO powder itself and the no-coat Cu powder were separately added to the composition (Com. Example 4).

As a result, the elution width and the volume resistivity when the no-coat Cu powder (Com. Example 3) was replaced with the 1 wt % or 3 wt % ZnO coat Cu powder (Example 6 and 7) on both the 100 μm wide electrode and 50 μm wide electrode as shown in Table 3. A notable result was the elution did not occur in Example 7. When using the no-coat Cu powder, the volume resistivity was too high to measure (Com. Example 3). The conductive paste containing the ZnO powder separately in addition to no-coat Cu powder could not even form an electrode because the exposed conductive layer was somehow not developable (Com. Example 4).

TABLE 3

| Composition (parts by weight) | Example 6 | Example 7 | Com. Example 3 | Corn. Example 4 |
|---|---|---|---|---|
| Cu powder[1)] | 1 wt % ZnO coat[2)] | 3 wt % ZnO coat[3)] | No-coat[4)] | No-coat[4)] |
| | 100.0 | 100.0 | 100.0 | 100.0 |
| B powder | 14.3 | 14.3 | 14.3 | 14.3 |
| $SiO_2$ powder | 3.9 | 3.9 | 3.9 | 3.9 |
| ZnO powder | 0.0 | 0.0 | 0.0 | 2.0 |
| Glass frit | 0.6 | 0.6 | 0.6 | 0.6 |
| Organic vehicle | 56.9 | 56.9 | 56.9 | 56.9 |
| Relative elution width | −77 | −100 | 0 | —[6)] |
| Volume resistivity (Ω · cm): 100 μm | $1.8 \times 10^5$ | $2.4 \times 10^5$ | —[5)] | —[6)] |
| Volume resistivity (Ω · cm): 50 μm | $1.9 \times 10^5$ | $3.2 \times 10^5$ | —[5)] | —[6)] |

[1)]Upper line: type of cu powder, lower line: Cu powder content
[2)]1 wt % ZnO coat 1100Y from Mitsui Mining & Smelting CO. LTD., SA: 0.86 $m^2/g$, D50: 1.18 μm. ZnO was 1 wt % based on the weight of the Cu powder.
[3)]3 wt % ZnO coat 1100Y from Mitsui Mining & Smelting CO. LTD., SA: 0.86 $m^2/g$, D50: 1.18 μm. ZnO was 3 wt % based on the weight of the Cu powder.
[4)]Bare Cu powder 1100Y from Mitsui Mining & Smelting CO. LTD., SA: 0.86 $m^2/g$, D50: 1.18 μm.
[5)]Unmeasurable level
[6)]Undevelopable Effect of the additional inorganic powder was examined. The electrode was made in the same manner in Example 1 except that the composition was as shown in Table 4 was used; and the firing setting peak temperature of firing was 580° C.

The electrode with less elution was formed when the Cu powder was coated with ZnO (Example 8 and 9), as compared to the conductive paste using the bare Cu powder (Com. Example 5) as shown in Table 4. The $SiO_2$ powder addition further reduced the elution width (Example 8).

TABLE 4

| Composition (parts by weight) | Example 8 | Example 9 | Com. Example 5 |
|---|---|---|---|
| Cu powder[1)] | 1 wt % ZnO coat[2)] | 1 wt % ZnO coat[2)] | No-coating[3)] |
| | 100 | 100 | 100.0 |
| B powder | 19.1 | 19.1 | 19.1 |
| $SiO_2$ powder | 4.0 | 0.0 | 0.0 |
| Glass frit | 0.6 | 0.6 | 0.6 |
| Organic vehicle | 67.4 | 67.4 | 67.4 |
| Relative elution width | −83 | −57 | 0 |

[1)]Upper line: type of cu powder, lower line: Cu powder content
[2)]1 wt % ZnO coat 1100Y from Mitsui Mining & Smelting CO. LTD., SA: 0.86 $m^2/g$, D50: 1.18 μm
[3)]Bare Cu powder 1100Y from Mitsui Mining & Smelting CO. LTD SA: 0.86 $m^2/g$, D50: 1.18 μm

What is claimed is:

1. A method for manufacturing an electrode comprising the steps of: applying onto a substrate a conductive paste to form a conductive paste layer comprising:

(i) 100 parts by weight of a copper powder coated with a metal oxide selected from the group consisting of silicon oxide ($SiO_2$), zinc oxide (ZnO), aluminum oxide ($Al_2O_3$), titanium oxide ($TiO_2$), magnesium oxide (MgO) and a mixture thereof;

(ii) 5 to 30 parts by weight of a boron powder; and (iii) 0.1 to 10 parts by weight of a glass frit; dispersed in (iv) an organic vehicle; and firing the conductive paste in air.

2. The method of claim 1, wherein the metal oxide coating the copper powder is 0.1 to 8 weight percent based on the weight of the copper powder.

3. The method of claim 1, wherein the average particle diameter of the copper powder is 0.08 to 10 μm.

4. The method of claim 1, wherein the average particle diameter of the boron powder is 0.1 to 5 μm.

5. The method of claim 1, wherein the conductive paste further comprises 0.5 to 10 parts by weight of an additional inorganic powder selected from the group consisting of silica powder, indium tin oxide powder, zinc oxide powder, alumina powder, and mixture thereof.

6. The method of claim 1 further comprising the step of, between the step of applying and the step of firing, exposing the conductive paste layer on a substrate to light, wherein the organic vehicle comprises a photo-polymerization compound and a photo-polymerization initiator.

7. The method of claim 6 further comprising the step of, between the step of exposing and the step of firing, developing the exposed conductive paste layer.

8. A conductive paste comprising:

(i) 100 parts by weight of a copper powder comprising copper powder coated with a metal oxide selected from the group consisting of silicon oxide ($SiO_2$), zinc oxide (ZnO), aluminum oxide ($Al_2O_3$), titanium oxide ($TiO_2$), magnesium oxide (MgO) and a mixture thereof;

(ii) 5 to 30 parts by weight of a boron powder; and (iii) 0.1 to 10 parts by weight of a glass frit; dispersed in (iv) an organic vehicle; and firing the conductive paste in air.

9. The conductive paste of claim 8, wherein the metal oxide coating the copper powder is 0.1 to 8 weight percent based on the weight of the copper powder.

10. The conductive paste of claim 8, wherein the organic vehicle comprises a photo-polymerization compound and a photo-polymerization initiator.

* * * * *